US005118593A

United States Patent [19]

Waki et al.

[11] Patent Number: 5,118,593

[45] Date of Patent: Jun. 2, 1992

[54] METHOD FOR COLOR IMAGE FORMATION

[75] Inventors: Kokichi Waki; Shigeo Hirano, both of Kanagawa, Japan

[73] Assignee: Fuji Photo Film Co., Ltd., Kanagawa, Japan

[21] Appl. No.: 762,170

[22] Filed: Sep. 19, 1991

Related U.S. Application Data

[63] Continuation of Ser. No. 441,216, Nov. 27, 1989, abandoned, which is a continuation of Ser. No. 8,450, Jan. 29, 1987, abandoned.

[30] Foreign Application Priority Data

Jan. 29, 1986 [JP] Japan ..... 61-18755

[51] Int. Cl.[5] ..... G03C 7/30; G03C 7/26

[52] U.S. Cl. ..... 430/377; 430/376; 430/380; 430/469; 430/487; 430/550

[58] Field of Search ..... 430/376, 377, 380, 469, 430/487, 550

[56] References Cited

U.S. PATENT DOCUMENTS

| | | | |
|---|---|---|---|
| 2,518,698 | 8/1950 | Lowe et al. | 430/599 |
| 2,521,925 | 9/1950 | Lowe et al. | 430/599 |
| 4,035,188 | 7/1977 | Yabata et al. | 430/467 |
| 4,090,879 | 5/1978 | Cheng | 430/484 |
| 4,298,673 | 11/1981 | Kubotera et al. | 430/487 |
| 4,299,914 | 11/1981 | Fujumastu et al. | 430/552 |
| 4,304,844 | 12/1981 | Fujumastu et al. | 430/552 |
| 4,443,536 | 4/1984 | Lestina | 430/552 |
| 4,524,132 | 6/1985 | Aoki et al. | 430/552 |
| 4,526,861 | 7/1985 | Ichisima et al. | 430/385 |
| 4,529,690 | 7/1985 | Ohbayashi et al. | 430/551 |
| 4,564,590 | 1/1986 | Sasaki et al. | 430/552 |
| 4,565,777 | 1/1986 | Ogawa et al. | 430/552 |
| 4,863,830 | 9/1989 | Okutsu et al. | 430/487 |

FOREIGN PATENT DOCUMENTS

| | | |
|---|---|---|
| 0668842 | 2/1966 | Belgium . |
| 082649 | 6/1983 | European Pat. Off. . |
| 086074 | 8/1983 | European Pat. Off. . |
| 093002 | 11/1983 | European Pat. Off. . |
| 148441 | 7/1985 | European Pat. Off. . |
| 151305 | 8/1985 | European Pat. Off. . |
| 0173203 | 8/1985 | European Pat. Off. . |
| 211437 | 2/1987 | European Pat. Off. . |
| 52058 | 4/1980 | Japan . |
| 200037 | 12/1982 | Japan . |
| 31334 | 2/1983 | Japan . |
| 42045 | 3/1983 | Japan . |
| 50536 | 3/1983 | Japan . |
| 48755 | 3/1984 | Japan . |
| 174836 | 10/1984 | Japan . |
| 177553 | 10/1984 | Japan . |
| 178459 | 10/1984 | Japan . |
| 26338 | 2/1985 | Japan . |
| 26339 | 2/1985 | Japan . |
| 158444 | 8/1985 | Japan . |
| 60-158446 | 8/1985 | Japan . |
| 162256 | 8/1985 | Japan . |
| 172042 | 9/1985 | Japan . |
| 70552 | 4/1986 | Japan . |
| 830250 | 2/1987 | Japan . |
| 1085827 | 10/1967 | United Kingdom . |

OTHER PUBLICATIONS

Patent Abstracts of Japan, vol. 4, No. 103, p. 20, 585, 23 Jul. 1980, 55-62451 (A) to Kuze.

*Primary Examiner*—Richard L. Schilling

*Attorney, Agent, or Firm*—Sughrue, Mion, Zinn, Macpeak & Seas

[57] ABSTRACT

A method of color image formation is disclosed, comprising imagewise exposing a color photographic light-sensitive material comprising a reflective support having provided thereon at least one light-sensitive layer containing a color coupler capable of forming a color image upon coupling with an oxidation product of an aromatic primary amine developing agent and a silver halide emulsion, and processing the exposed light-sensitive material with a color developing solution containing substantially no benzyl alcohol within a development time of 2 minutes and 30 seconds, wherein said processing is carried out in the pressence of at least one compound represented by formula wherein $R^1$, $R^2$, $R^3$, and $R^4$ each represents a hydrogen atom, a hydroxyl group, a substituted or unsubstituted alkyl group, a substituted or unsubstituted alkenyl group, a substituted or unsubstituted alkynyl group, an acyl group, or a sulfonyl group; or $R^1$ and $R^2$, or $R^3$ and $R^4$ together form a ring; X represents a substituted or unsubstituted lower alkylene group; and n represents an integer of from 1 to 4. Disadvantages due to use of benzyl alcohol can be eliminated, and reduction in color density noted when color development processing is conducted over a short time without using benzyl alcohol can be prevented.

20 Claims, No Drawings

METHOD FOR COLOR IMAGE FORMATION

This is a continuation of application Ser. No. 07/441,216, filed Nov. 27, 1989, now abandoned, which is a continuation of application Ser. No. 07/008,450, filed Jan. 29, 1987, now abandoned.

FIELD OF THE INVENTION

This invention relates to a method for color image formation, and more particularly to a color image formation method which allows rapid processing by achieving efficient development with a reduced silver coverage.

BACKGROUND OF THE INVENTION

It is known that a color image can be formed by imagewise exposing light-sensitive layers containing yellow, magenta and cyan couplers (i.e., yellow dye-forming coupler, etc.) and processing the exposed layers with a color developing agent whose oxidized product is capable of coupling with the couplers to form the respective dyes. According to this color image formation system, it is important that a light-sensitive material having a silver halide coverage as small as possible be developed to efficiently form a color within a limited development time.

Efficient color formation requires rapid progress of silver halide development and complete development of silver halide to be developed without any residual, a so-called "dead grain". It is also important that the thus produced oxidation product of a color developing agent should react with a color coupler without being wasted. It is known that these requirements can be met by using silver halides having a high developing speed or silver halides having a high rate of development, i.e., a low dead grain rate, and, in fact, silver chloride or silver chlorobromide emulsions can sometimes be employed to achieve this effect. In cases when such a silver halide cannot be used, e.g., in high-speed photographing, it is also known to increase the silver halide coverage with respect to a color coupler to thereby accelerate or ensure color formation. Use of couplers having a high rate of coupling is furthermore effective. It is also beneficial to heighten the developing activity of a color developing solution per se.

In an attempt to increase the rate of color development of color developing solutions, various methods have hitherto been proposed. In particular, there have been proposed various additives for accelerating penetration of a color developing agent into coupler-containing oil droplets, where the color developing agent finally undergoes coupling with the coupler to form a dye. Among these additives, benzyl alcohol known to produce a particularly great effect in color formation acceleration, and has been employed for processing of various types of color photographic light-sensitive materials, and is still used widely for processing of color papers.

Since benzyl alcohol has poor solubility, though it is soluble in water to some extent, diethylene glycol, triethylene glycol, or an alkanolamine may be employed in combination to increase the solubility.

However, these compounds and benzyl alcohol itself become a source of pollution when discharged to cause high BOD (biochemical oxygen demand) and COD (Chemical oxygen demand). From the standpoint of waste water disposal, therefore, it has been strongly desired to remove or at least reduce benzyl alcohol despite of the above-described advantages, such as improved color developability or improved solubility.

Moreover, the use of the above-described solvents, e.g., diethylene glycol, is still insufficient to achieve satisfactory solubility of benzyl alcohol, and costs both time and labor for the preparation of a developing solution.

If benzyl alcohol is carried with a developing solution and accumulated in the subsequent belaching or bleach-fix bath, the accumulated benzyl alcohol may form one of causes of leuco compound formation depending on the kind of cyan dyes, ultimately leading to reduction in color density. It is also noted that such accumulation of benzyl alcohol brings insufficiency in washing-away of developing solution components, and particularly a color developing agent, in the washing step. The developing solution components remaining unwashed away result in deterioration of image stability.

From all these considerations, reduction or removal of benzyl alcohol from a color developing solution has a great significance.

In addition to the above-described problems, it has been keenly demanded to shorten a processing time in order to cope with the recent demands of users.

However, conventional techniques failed to fulfill both the aforesaid requirements, i.e., reduction or removal of benzyl alcohol and reduction of a processing time. In other words, reduction of development time combined with removal of benzyl alcohol from a color developing solution has been found to obviously result in serious reduction in color density.

Hitherto various techniques have been reported to shorten a processing time with no or a reduced amount of benzyl alcohol in a color developing solution. For example, Japanese Patent Application (OPI) Nos. 174836/84 and 177553/84 (the term "OPI" as used herein means "unexamined published application") disclose introduction of a specific group into a color coupler and also disclose addition of polyalkylene oxides, or ethers, esters or amine derivatives thereof, thioethers, thiomorpholines, tertiary ammonium salt compounds, urethane derivatives, urea derivatives, imidazole derivatives, 3-pyrazolidones, or the like in a photographic emulsion layer of a photographic light-sensitive material containing the color coupler so as to accelerate the development. This technique is effective for the purpose but is still not satisfactory.

SUMMARY OF THE INVENTION

Accordingly, one object of this invention is to provide a method for color image formation by which development processing can be carried out in a reduced development time with a color developing solution containing substantially no benzyl alcohol without involving a reduction in color density.

This object of this invention can be accomplished by a method for color image formation comprising imagewise exposing a color photographic light-sensitive material comprising a reflective support having provided thereon at least one light-sensitive layer containing a color coupler capable of forming a color image upon coupling with an oxidation product of an aromatic primary amine developing agent and a silver halide emulsion, and processing the exposed light-sensitive material with a color developing solution containing substantially no benzyl alcohol within a development time of 2 minutes and 30 seconds, wherein said processing is carried out in the presence of at least one compound represented by formula (I)

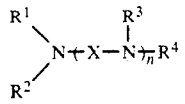

(I)

wherein $R^1$, $R^2$, $R^3$ and $R^4$ each represents a hydrogen atom, a hydroxyl group, a substituted or unsubstituted alkyl group, a substituted or unsubstituted alkenyl group, a substituted or unsubstituted alkynyl group, an acyl group, or a sulfonyl group; or $R^1$ and $R^2$, or $R^3$ and $R^4$ together form a ring; X represents a substituted or unsubstituted lower alkylene group; and n represents an integer of from 1 to 4.

DETAILED DESCRIPTION OF THE INVENTION

In formula (I), the alkyl group as represented by $R^1$, $R^2$, $R^3$, or $R^4$ preferably contains from 1 to 6 carbon atoms, and includes, for example, a methyl group, an ethyl group, an isopropyl group, an n-butyl group, an n-hexyl group, etc. The alkenyl group as represented by $R^1$, $R^2$, $R^3$, or $R^4$ preferably contains from 2 to 6 carbon atoms and includes, for example, an allyl group, etc. The alkynyl group as represented by $R^1$, $R^2$, $R^3$, or $R^4$ preferably contains from 2 to 6 carbon atoms and includes, for example, a propargyl group. These alkyl, alkenyl and alkynyl groups may have substituents. Examples of the substituents are an alkoxy group (preferably having from 1 to 3 carbon atoms), a hydroxyl group, an amino group, a carboxyl group, a sulfo group, etc. The acyl group as represented by $R^1$, $R^2$, $R^3$, or $R^4$ preferably contains from 1 to 10 carbon atoms and includes a formyl group, an acetyl group, a propionyl group, a benzoyl group, etc. The sulfonyl group as represented by $R^1$, $R^2$, $R^3$, or $R^4$ preferably contains from 1 to 10 carbon atoms and includes a methanesulfonyl group, an ethanesulfonyl group, a benzenesulfonyl group, etc.

The ring formed by $R^1$ and $R^2$, $R^3$ and $R^4$ is preferably a saturated 5- or 6-membered ring, such as a pyrrolidine ring, a perhydropyridine ring, a morpholine ring, etc.

Of the compounds represented by formula (I), those wherein $R^1$, $R^2$, $R^3$, or $R^4$ is a hydrogen atom, a substituted or unsubstituted alkyl group, a substituted or unsubstituted alkynyl group are preferred. The more preferred are those wherein $R^1$, $R^2$, $R^3$, or $R^4$ is a hydrogen atom, a methyl group, or an ethyl group, and most preferred are those wherein each of $R^1$, $R^2$, $R^3$, and $R^4$ is hydrogen atom.

The alkylene group as represented by X includes a straight chain or branched chain alkylene group preferably containing from 2 to 4 carbon atoms and more preferably two or three carbon atoms such as $-CH_2CH_2-$ and $-CH_2CH_2CH_2-$. The alkylene group may have substituents as described above with respect to $R^1$ to $R^4$.

n preferably represents 1 or 2.

Specific but non-limiting examples of the compounds of formula (I) are shown below.

$H_2NCH_2CH_2NH_2$ (1)

$H_2N\text{+}CH_2CH_2NH\text{+}_2H$ (2)

-continued $H_2N\text{+}CH_2CH_2NH\text{+}_3H$ (3)

$H_2N\text{+}CH_2CH_2NH\text{+}_4H$ (4)

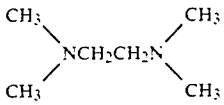

(5)

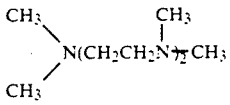

(6)

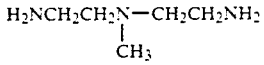

(7)

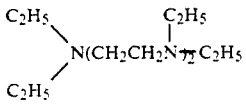

(8)

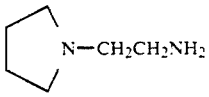

(9)

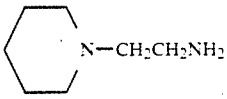

(10)

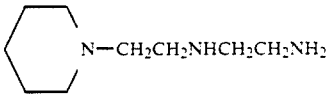

(11)

$(CH_2{=}CHCH_2)_2N-CH_2CH_2N(CH_3)CH_2CH_2N(CH_2CH{=}CH_2)_2$ (12)

$(CH{\equiv}CCH_2)_2N-CH_2CH_2N(CH_3)CH_2CH_2N(CH_2C{\equiv}CH)_2$ (13)

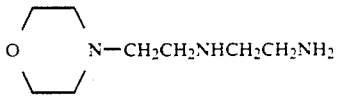

(14)

$HOCH_2CH_2NHCH_2CH_2NH_2$ (15)

$HOOCCH_2NHCH_2CH_2NHCH_2CH_2NH_2$ (16)

$HO_3SCH_2CH_2NHCH_2CH_2NHCH_2CH_2NH_2$ (17)

$H_2NCH_2CH_2N(C_6H_{13})CH_2CH_2NH_2$ (18)

$CH_3CONHCH_2CH_2NHCH_2CH_2NHCOCH_3$ (19)

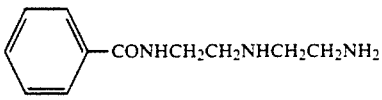

(20)

$(HOOCCH_2)_2NCH_2CH_2N(CH_2COOH)CH_2CH_2N(CH_2COOH)_2$ (21)

$CH_3SO_2NHCH_2CH_2NHCH_2CH_2NHCH_2CH_2NH_2$ (22)

-continued $CH_3SO_2NHCH_2CH_2NHCH_2CH_2NHSO_2CH_3$ (23)

$H_2NCH_2CH_2CH_2NH_2$ (24)

$H_2NCH_2CH_2CH_2NHCH_2CH_2NH_2$ (25)

$H_2NCH_2CH_2NHCH_2CH_2CH_2NHCH_2CH_2NH_2$ (26)

$H_2N\text{-}(CH_2CH_2NH)_3\text{-}H$ (27)

$H_2NCH_2CH_2NHCH_2CH_2CH_2NH_2$ (28)

$CH_3NHCH_2CH_2CH_2NHCH_2CH_2NH_2$ (29)

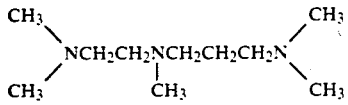
(30)

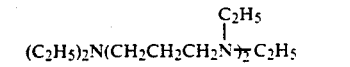
(31)

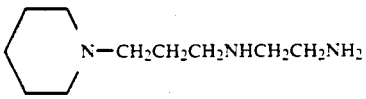
(32)

$CH_3CONHCH_2CH_2CH_2N(COCH_3)CH_2CH_2CH_2NHCOCH_3$ (33)

$(HOOCCH_2)_2NCH_2CH_2CH_2N(CH_2COOH)CH_2CH_2CH_2N(CH_2COOH)_2$ (34)

The compounds of formula (I) are known per se and can be synthesized by the method of R. B. Wagner and H. D. Zook, *Synthetic Organic Chemistry*, pp. 653–727, John Wiley and Sons, Inc., New York (1953) or the method of S. R. Sandler and W. Karo, *Organic Functional Group Preparations*, pp. 317–362, Academic Press, New York (1968).

The process for synthesizing below in detail with reference to polyamine compounds represented by formula (I) that are particularly preferred in the present invention.

Reaction Scheme:

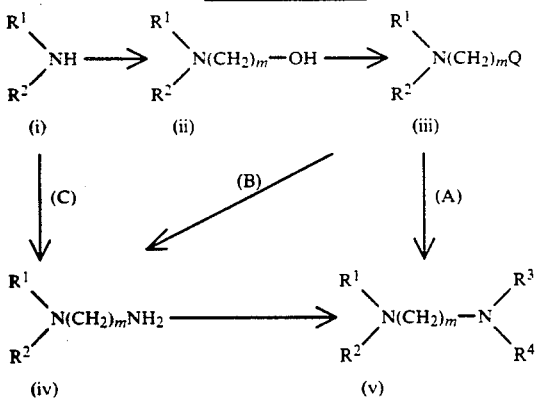

wherein $R_1$, $R_2$, $R_3$, and $R_4$ each is as defined above, Q is Cl or Br, and m is 2 or 3.

Route A:

The amine derivative (i) is reacted with an alkylating agent, e.g., ethylene oxide, oxetane, chlorohydrin, bromohydrin, 3-chloropropanol, etc., in a solvent, e.g., alcohols, ethers, etc., to obtain the compound (ii). If the reaction is accompanied by by-production of a strong acid, e.g., HCl or HBR, an acid scavenger, e.g., pyridine, sodium hydrogencarbonate, etc., may be used. The compound (ii) is then reacted with a halogenating agent, e.g., thionyl chloride, phosphorus trichloride, phosphorus pentachloride, phosphorus tribromide, phosphorus oxychloride, etc. The resulting halogen derivative (iii) is reacted with an appropriate amine having formula

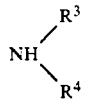

is the presence of a base, e.g., pyridine, sodium hydrogencarbonate, etc., to obtain the desired diamine compound (v).

Route B:

The halogen derivative (iii) is reacted with ammonia, hexamethylenetetramine, potassium phthalimide, or the like to form a primary amine compound (iv), which is then alkylated with $R^3Br$, $R^4Ts$ (Ts: tosyl group), etc., to obtain the desired compound (v).

The compound (v) wherein either one of $R^3$ and $R^4$ is an acyl group, a sulfonyl group, an alkoxycarbonylethyl group or a carboxymethyl group with the another being a hydrogen atom can be prepared by reacting the primary amine compound (iv) with a carboxylic acid chloride, a sulfonic acid chloride, an acrylic ester, or α-bromoacetic acid, respectively.

Route C:

The primary amine compound (iv) can also be synthesized by the reaction between the compound (i) with ethyleneimide or azetidine.

In the present invention, the compound of formula (I) should be present at the time of color development and may be added to a layer(s) of a light-sensitive material and/or a color developing solution. When the compound (I) is incorporated in the light-sensitive layers and it is added to at least one of light-sensitive layers and light-insensitive layers.

When the compound (I) is added to a developing solution, the amount to be added preferably ranges from $1\times10^{-5}$ to $5\times10^{-2}$ mol per liter, and more preferably from $1\times10^{-4}$ to $1\times10^{-2}$ mol per liter. When the compound (I) is added to a light-sensitive material, the amount to be added is preferably from $5\times10^{-7}$ to $5\times10^{-2}$ mol/m$^2$, and more preferably from $5\times10^{-6}$ to $5\times10^{-3}$ mol/m$^2$.

The color developing solution which can be used in the present invention contains substantially no benzyl alcohol. The terminology "substantially no benzyl alcohol" means that the developing solution contains no benzyl alcohol or not more than 0.5 ml/liter of benzyl alcohol.

When benzyl alcohol as a color formation accelerator is not used and the development time is reduced, color densities tend to be greatly decreased, as described above. This problem could not be solved even with the aid of various color development accelerators disclosed, e.g., in U.S. Pat. Nos. 2,950,970, 2,515,147, 2,496,903, 2,304,925, 4,038,075, and 4,119,462, British Patents 1,430,998 and 1,455,413. Japanese Patent Application (OPI) Nos. 15831/78, 62450/80, 62451/80, 62452/80, 62453/80, and Japanese Patent Publication Nos. 12422/76 and 49728/80.

Differing from these conventional color development accelerators, the compounds of formula (I) according to the present invention bring about noticeable effects on increase of color density as well as sensitivity. Surprisingly, these effects are more conspicuous in a color developer containing substantially no benzyl alcohol than in a developer containing benzyl alcohol, which is not anticipated from any known techniques for development acceleration.

Polyamine compounds have conventionally attracted attention as reduction sensitizers. For example, U.S. Pat. Nos. 2,518,698 and 2,521,925 disclose that spermine having an ethylene diamine-like structure increases sensitivity of silver halide emulsions. U.S. Pat. No. 2,743,182 discloses that spermine and other polyamines exhibit high sensitizing effects particularly in an emulsion system having been subjected to a combination of sulfur sensitization and gold sensitization. Sensitizing effects of cyclic polyamines are suggested in West German Patent 2,461,919. Further, polyamine compounds are known to have effects in acceleration of desilvering in color development processing. For instance, U.S. Pat. No. 3,578,454 describes that presence of a polyamine in a bleach-fix bath or its prebath accelerates desilvering, and U.S. Pat. No. 4,552,834 describes that diamines having a phenylene linking group accelerate desilvering. Further, polyamine compounds are known to have effects in development acceleration. For example, U.S. Pat. No. 3,523,796 discloses that polyamine compounds having an ether group have development accelerating effects. However, none of these patents refers to the absence or presence of benzyl alcohol in a developing solution.

Silver halide emulsions which can be used in the present invention preferably have a mean grain size of from 0.1 to 2 μm, and more preferably from 0.2 to 1.3 μm, expressed as the diameter of a circle having the same area as the projected area. The silver halide emulsions are preferably mono-dispersed emulsions having narrow size distribution as having an $S/\bar{d}$ ratio of 0.2/1 or less, and more preferably 0.15/1 or less, wherein S is a statistical standard deviation and $\bar{d}$ is a mean grain size.

The silver halide emulsions to be used may have any halogen composition, but preferably comprise silver bromide and/or silver chlorobromide containing substantially no silver iodide, and more preferably silver chlorobromide containing from 20 to 98 mol % of silver bromide. In the case of reducing the developing time to a great extent, silver chloride or silver chlorobromide containing 90 mol % or more (more preferably 95 mol % or more) of silver chloride are particularly preferred.

Silver halide grains to be used may have a homogeneous phase throughout the individual grains or a heterogeneous phase having a core-shell structure or a fused structure, or a mixture thereof.

The silver halide grains may have a regular crystal form, such as cubic, octahedral, dodecahedral, tetradecahedral, etc., an irregular crystal form, e.g., spherical, etc., or may be a composite crystal form thereof. Those having a regular crystal form such as cubic and tetradecahedral are preferred. Plate-like (tabular) grains may also be employed. In particular, plate-like grains having a diameter/thickness ratio of 5 or more (i.e., 5/1 or more), and preferably 8 or more, can be used in a proportion of at least 50% based on the total projected area of grains. The emulsions may comprise a mixture of these various crystal forms. The emulsions may be either of the surface latent image type, in which a latent image is predominantly formed on the surface of silver halide grains, or the inner latent image type, in which a latent image is predominantly formed in the inside of the grains, with the former being preferred.

The photographic emulsions to be used in the invention can be prepared by known processes as described in P. Glafkides, *Chimie et Physique Photographique*, Paul Montel (1967), G.F. Duffin, *Photographic Emulsion Chemistry*, Focal Press (1966), V.L. Zelikman et al., *Making and Coating Photographic Emulsion*, Focal Press (1964), etc. In some detail, the emulsions can be prepared by any of the acid process, the neutral process, the ammonia process, and the like. The reaction between a soluble silver salt and a soluble halogen salt can be effected by any of a single jet method, a double jet method, and a combination thereof. A so-called reverse mixing method, in which grains are formed in the presence of excess silver ions, may be used. A so-called controlled double jet method, in which a pAg level of a liquid phase where grains are formed is maintained constant, may also be used. According to this method, a silver halide emulsion having a regular crystal form and a nearly uniform grain size can be obtained.

The emulsion may also be prepared by a so-called conversion method which includes conversion of silver halide grains formed to those grains having a smaller solubility product by the end of the grain formation process. Emulsions having been subjected to such halogen conversion after the end of the grain formation may also be employed.

During the silver halide grain formation or the subsequent physical ripening, the system may contain a cadmium salt, a zinc salt, a lead salt, a thallium salt, an iridium salt or a complex salt thereof, a rhodium salt or a complex salt thereof, an iron salt or a complex salt thereof, etc. to prevent reciprocity failure, to increase the sensitivity, or to control the gradation, etc.

The thus prepared silver halide emulsions are usually subjected to physical ripening, desalting, and chemical ripening prior to coating.

Known silver halide solvents can be used :n the steps of precipitation, physical ripening, and chemical ripening. Examples of these silver halide solvents include ammonia, potassium thiocyanate, and thioethers and thione compounds described in U.S. Pat. No. 3,271,157 and Japanese Patent Application (OPI) Nos. 12360/76, 82408/78, 144319/78, 100717/79 and 155828/79, etc. Soluble silver salts can be removed from the emulsion after physical ripening in accordance with the noodle washing method, the flocculation (sedimentation) method, the ultrafiltration method, and the like.

Chemical sensitization of the silver halide emulsions includes sulfur sensitization using active gelatin or a sulfur-containing compound capable of reacting with silver (e.g., thiosulfates, thioureas, mercapto compounds, rhodanines, etc.); reduction sensitization using a reducing substance (e.g., stannous salts, amines, hydrazine derivatives, formamidinesulfinic acid, silane compounds, etc.); novel metal sensitization using a metal compound (e.g., a gold complex salt as well as a complex salt of a metal of the Group VIII of the Periodic Table, e.g., Pt, Ir, Pd, Rh, Fe, etc.), and combinations thereof. Of these sensitization techniques, use of sulfur sensitization alone is preferred.

For the purpose of obtaining desired gradation, two or more mono-dispersed silver halide emulsions (preferably those having an $S/\bar{d}$ ratio falling within the above-described ratio) being different in grain size can be mixed and coated in a single layer or separately coated in two or more layers having substantially the same color sensitivity. It is also possible to coat two or more poly-dispersed silver halide emulsions or a combination of a mono-dispersed emulsion and a poly-dispersed emulsion in a single layer or different layers.

The silver halide emulsions are spectrally sensitized with methine dyes or others so as to have blue-sensitivity, green-sensitivity, or red-sensitivity. Sensitizing dyes to be used include cyanine dyes, merocyanine dyes, complex cyanine dyes, complex merocyanine dyes, holopolar cyanine dyes, hemicyanine dyes, styryl dyes, and hemioxonol dyes, with cyanine dyes, merocyanine dyes, and complex merocyanine dyes being particularly useful. Any of nuclei commonly employed in cyanine dyes as a basic heterocyclic nucleus is applicable to these dyes. Such nuclei include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., the above-enumerated nuclei to which an alicyclic hydrocarbon ring is fused; and the above-enumerated nuclei to which an aromatic hydrocarbon ring is fused, e.g., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, and the like. These nuclei may have a substituent(s).

Nuclei having a ketomethylene structure that are applicable to merocyanine dyes or complex merocyanine dyes include 5- or 6-membered heterocyclic nuclei, e.g., a pyrazolin-5-one nucleus, a thiohydantoin nucleus, a 2-thioxazolidine-2,4-dione nucleus, a thiazolidine-2,4-dione nucleus, a rhodanine nucleus, a thiobartiburic acid nucleus, etc.

These sensitizing dyes may be used individually or in combinations thereof. Combinations of sensitizing dyes are frequently employed for the purpose of super-sensitization. Typical examples of combinations of sensitizing dyes for supersensitization are given, e.g., in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patents 1,344,281 and 1,507,803, Japanese Patent Publication Nos. 4936/68 and 12375/78, and Japanese Patent Application (OPI) Nos. 110618/77 and 109925/77.

The silver halide emulsions may further contain, in combination with the sensitizing dyes, dyes which do not per se have spectral sensitizing activity, or substances which do not substantially absorb visible light, but which do show supersensitizing effects.

Color couplers to be incorporated in the light-sensitive materials preferably have a ballast group or a polymerized form and are thereby non-diffusible. Two-equivalent color couplers wherein the coupling active position is substituted with a releasable group are preferred to 4-equivalent color couplers wherein the coupling active position is a hydrogen atom because the use of the former reduces the requisite silver coverage. Couplers producing dyes having moderate diffusibility, colorless couplers, DIR couplers capable of releasing a developing inhibitor upon coupling reaction, or DAR couplers capable of releasing a development accelerator upon coupling reaction may also be used.

Yellow couplers which can be used in the invention typically include oil-protected type acylacetamide couplers. Specific examples of these couplers are described, e.g., in U.S. Pat. Nos. 2,407,210, 2,875,057, and 3,265,506. Two-equivalent yellow couplers are preferably used from the above-described reason. Typical examples of the 2-equivalent yellow couplers include oxygen atom-releasing types as described in U.S. Pat. Nos. 3,408,194, 3,447,928, 3,933,501, and 4,022,620, and nitrogen atom-releasing types as described in Japanese Patent Publication No. 10739/83, U.S. Pat. Nos. 4,401,752 and 4,326,024, Research Disclosure (RD) 18053 (Apr., 1979), British Patent 1,425,020, and West German Patent (OLS) Nos 2,219,917, 2,261,361, 2,329,587, and 2,433,812. α-Pivaloylacetanilide couplers produce dyes excellent in fastness, particularly to light. α-Benzoylacetanilide couplers provide high color densities.

Magenta couplers which can be used in the invention include oil-protected type indazolone couplers, cyanoacetyl couplers, and preferably 5-pyrazolone couplers and pyrazoloazole couplers (such as pyrazolotriazoles). Of the 5-pyrazolone couplers, those having an arylamino group or an acylamino group at the 3-position thereof are prefer red in view of hue and color density. Typical examples of such couplers are described in U.S. Pat. Nos. 2,311,082, 2,343,703, 2,600,788, 2,908,573, 3,062,653, 3,152,896, and 3,936,015. Preferred releasable groups for 2-equivalent 5-pyrazolone couplers are nitrogen-releasing groups described in U.S. Pat. No. 4,310,619 and arylthio groups described in U.S. Pat. No. 4,351,897. 5-Pyrazolone couplers having the ballast group described in European Patent 73,636 provide high color densities.

The pyrazoloazole couplers include pyrazolobenzimidazoles as described in U.S. Pat. No. 3,369,879, and preferably pyrazolo[5,1-c][1,2,4]triazoles as described in U.S. Pat. No. 3,725,067, pyrazolotetrazoles as described in RD 24220 (June, 1984), and pyrazolopyrazoles as described in RD 24230 (June, 1984). Imidazo[1,2-b]pyrazoles as described in European Patent 119,741 are preferred as the produced dyes show reduced side absorption of yellow and light-fastness. Pyrazolo[1,5-b][1,2,4]triazoles as described in European Patent 119,860 are particularly preferred.

Cyan couplers to be used in the invention include oil-protected type naphtholic and phenolic couplers Typical examples are naphtholic couplers described in U.S. Pat. No. 2,474,293, and preferably oxygen atom-releasing type 2-equivalent naphtholic couplers as described in U.S. Pat. Nos. 4,052,212, 4,146,396, 4,228,233, and 4,296,200. Specific examples of the phenolic couplers and described in U.S. Pat. Nos. 2,369,929, 2,801,171, 2,772,162, and 2,895,826. Cyan couplers producing dyes fast to moisture and heat are preferably used. Typical examples of such cyan couplers include phenolic couplers having an alkyl group containing 2 or more carbon atoms at the m-position of the phenol nucleus as disclosed in U.S. Pat. No. 3,772,002; 2,5-diacylamino-substituted phenolic couplers as described in U.S. Pat. Nos. 2,772,162, 3,758,308, 4,126,396, 4,334,011, and 4,327,173, West German Patent (OLS) No. 3,329,729, and Japanese Patent Application (OPI) No. 166956/84; and phenolic couplers having a phenylureido group at the 2-position and an acylamino group at the 5-position as described in U.S. Pat. Nos. 3,446,622, 4,333,999, 4,451,559, and 4,427,767.

Graininess can be improved by using a coupler producing a dye having moderate diffusibility in combination with the above-described color couplers. Specific examples of such couplers are described in U.S. Pat. No. 4,366,237 and British Patent 2,125,570 as to magenta couplers; and European Patent 96,570 and West German Patent (OLS) No. 3,234,533 as to yellow, magenta, and cyan couplers.

The color-forming couplers as well as the aforesaid special couplers may be used a polymerized form, inclusive of a dimer. Typical examples of color-forming polymeric couplers are described in U.S. Pat. Nos. 3,451,820 and 4,080,211. Specific examples of magenta polymeric couplers are described in British Patent 2,102,173 and U.S. Pat. No. 4,367,282.

For the purpose of satisfying various requirements for the light-sensitive material, two or more of these various couplers can be used in the same layer, or one of these couplers may be introduced into two or more different layers.

The couplers are introduced to the light-sensitive material in accordance with an oil-in-water dispersion method, in which couplers are dissolved in a high-boiling organic solvent having a boiling point of 175° C. or higher and/or a low-boiling auxiliary solvent, and the solution is finely dispersed in an aqueous medium, e.g., water, a gelatin aqueous solution, etc., in the presence of a surface active agent. Examples of the high-boiling organic solvent to be used are described, e.g., in U.S. Pat. No. 2,322,027. The dispersion may be attended by phase conversion If desired, the auxiliary solvent used may be removed or reduced prior to coating by distillation, noodle washing, ultrafiltration, or like technique.

Specific examples of the high-boiling organic solvents are phthalic esters (e.g., dibutyl phthalate, dicyclohexyl phthalate, di-2-ethylhexyl phthalate, decyl phthalate, etc.), phosphoric or phosphonic esters (e.g., triphenyl phosphate, tricresyl phosphate, 2-ethylhexyldiphenyl phosphate, tricyclohexyl phosphate, tri-2-ethylhexyl phosphate, tridecyl phosphate tributoxyethyl phosphate, trichloropropyl phosphate, di-2-ethylhexylphenyl phosphate, etc.), benzoic esters (e.g., 2-ethylhexyl benzoate, dodecyl benzoate, 2-ethylhexyl p-hydroxybenzoate, etc.), amides (e.g., diethyldodecaneamide, N-tetradecyl pyrrolidone, etc.), alcohols or phenols (e.g., isostearyl alcohol, 2,4-di-t-amylphenol, etc.), aliphatic carboxylic acid esters (e.g., dioctyl azelate, glycerol tributylate, isostearyl lactate, trioctyl citrate, etc.), aniline derivatives (e.g., N,N-dibutyl-2-butoxy-5-t-octylaniline, etc.), hydrocarbons (e.g., paraffin, dodecylbenzene, diisopropylnaphthalene, etc.), and the like. The auxiliary organic solvents have a boiling point of at least about 30° C., and preferably from 50° C. to about 160° C., and typically include ethyl acetate, butyl acetate, ethyl propionate, methyl ethyl ketone, cyclohexanone, 2-ethoxyethyl acetate, dimethylformamide, etc.

When introduction of couplers to the light-sensitive material is carried out by a latex dispersion method, the effects and specific examples of latices for impregnation are described, e.g., in U.S. Pat. No. 4,199,363, and West German Patent (OLS) Nos. 2,541,274 and 2,541,230.

A standard amount of color couplers to be used ranges from 0.001 to 1 mol per mol of a light-sensitive silver halide. Preferred amounts of yellow couplers, magenta couplers, and cyan couplers are from 0.01 to 0.5 mol, from 0.003 to 0.3 mol, and from 0.002 to 0.3 mol, respectively, per mol of a light-sensitive silver halide.

The light-sensitive material of the invention may contain a color fog inhibitor or color mixing inhibitor, such as a hydroquinone derivative, an aminophenol derivative, an amine, a gallic acid derivative, a catechol derivative, an ascorbic acid derivative, a colorless coupler, a sulfonamidophenol derivative, and the like.

The light-sensitive material of the invention can contain known discoloration inhibitors. Examples of organic discoloration inhibitors include hydroquinones, 6-hydroxychromans, 5-hydroxycoumarans, spirochromans, p-alkoxyphenols, hindered phenols (particularly bisphenols), gallic acid derivatives, methylenedioxybenzenes, aminophenols, hindered amines, and ether or ester derivatives of these compounds in which a phenolic hydroxyl group is silylated or alkylated. Metal complexes may also be used as discoloration inhibitor, such as (bissalicylaldoximato)nickel complexes and (bis-N,N-dialkyldithiocarbamato)nickel complexes.

Compounds having both partial structures of hindered amines and hindered phenols in the molecule thereof as described in U.S. Pat. No. 4,268,593 are effective to prevent deterioration of yellow dye images due to heat, moisture, and light. Spiroindanes described in Japanese Patent Application (OPI) No. 159644/81 and chromans substituted with a hydroquinone diether or monoether described in Japanese Patent Application (OPI) No. 89835/80 are effective to prevent magenta dye images from deterioration, particularly due to light.

For the purpose of improving preservability and particularly light-fastness of cyan images, use of benzotriazole type ultraviolet absorbents is desirable. These ultraviolet absorbents may be coemulsified with cyan couplers.

The ultraviolet absorbents are coated in an amount sufficient to impart light stability to cyan dye images, while too a large amount sometimes causes yellowing of unexposed areas of color photographic light-sensitive materials. Accordingly, the amount of the ultraviolet absorbent to be coated usually ranges from $1\times10^{-4}$ to $2\times10^{-3}$ mol/m$^2$, and preferably from $5\times10^{-4}$ to $1.5\times10^{-3}$ mol/m$^2$.

In color papers having an ordinary layer structure, the ultraviolet absorbent is incorporated in either one, and preferably both, of layers adjacent to a cyan coupler-containing red-sensitive emulsion layer. When it is incorporated in an intermediate layer between a green-sensitive layer and a red-sensitive layer, it may be coemulsified with a color mixing inhibitor. When the ultraviolet absorbent is added to a protective layer, another independent protective layer may be provided as an outermost layer. This outermost protective layer may contain a matting agent having an optional particle size.

In the light-sensitive material of the present invention, the ultraviolet absorbents can be added to any hydrophilic colloidal layer.

The hydrophilic colloidal layer of the light-sensitive material of the invention can contain a water-soluble dye as a filter dye or for various purposes, such as prevention of irradiation or halation.

The photographic emulsion layers or other hydrophilic colloidal layers can further contain a brightening agent, such as stilbenes, triazines, oxazoles, coumarins, and the like. The brightening agents may be either water-soluble or water-insoluble, and the water-insoluble agents may be used in the form of a dispersion.

As described above, the present invention is applicable to multi-layer multicolor photographic materials comprising a support having provided thereon at least two layers being different in spectral sensitivity. Multilayer natural color photographic materials usually comprise a support having provided thereon at least one each of a red-sensitive emulsion layer, a green-sensitive emulsion layer, and a blue-sensitive emulsion layer. The building-up order of these layers is arbitrarily selected depending on necessity. Each of the red-, green-, and blue-sensitive layers may be composed of two or more layers different in sensitivity. Further, two or more emulsion layers having the same color sensitivity may have a light-insensitive layer therebetween.

In addition to the silver halide emulsion layers, the light-sensitive materials may appropriately have auxiliary layers, such as protective layers, intermediate layers, a filter layer, an antihalation layer, a backing layer, etc.

Binders or protective colloids to be used in the emulsion layers or intermediate layers include gelatin to advantage. Other hydrophilic colloids are also employable, such as proteins, e.g., gelatin derivatives, graft polymers of gelatin and other high polymers, albumin, casein, etc.; sugar derivatives, e.g., cellulose derivatives (e.g., hydroxyethyl cellulose, carboxymethyl cellulose, cellulose sulfate, etc.), sodium alginate, starch derivatives, etc.; and a wide variety of synthetic hydrophilic polymers, e.g., polyvinyl alcohol partial acetal, poly-N-vinylpyrrolidone, polyacrylic acid, polymethacrylic acid, polyacrylamide, polyvinylimidazole, polyvinylpyrazole, etc., and copolymers thereof.

Gelatin to be used includes not only lime-processed gelatin but acid-processed gelatin, enzyme-processed gelatin as described in *Bull. Soc. Sci. Photo. Japan*, No. 16, p. 30 (1966) as well as hydrolysis products or enzymatic decomposition products of gelatin.

The light-sensitive material of the invention can contain, in addition to the aforesaid additives, stabilizers, stain inhibitors, developing agents or precursors thereof, development accelerators or precursors thereof, lubricants, mordants, matting agents, antistats, plasticizers, and any other photographically useful additives. Typical examples of such additives are described in *Research Disclosure*, RD 17643 (Dec., 1978) and RD 18716 (Nov., 1979).

The reflective support which can be used in this invention is a support having increased reflectivity to make the formed dye image distinct Such a reflective support includes a support coated with a hydrophobic resin having dispersed therein a light reflecting substance, e.g., titanium oxide, zinc oxide, calcium carbonate, calcium sulfate, etc.; and a support made of such a hydrophobic resin. Examples of these supports are baryta paper, polyethylene-coated paper, polypropylene synthetic paper, and transparent supports having a reflective layer or containing a reflecting substance, e.g., a glass plate, a polyester film (e.g., polyethylenc terephthalate film, a cellulose triacetate film, a cellulose nitrate film, etc.), a polyamide film, a polycarbonate film, a polystyrene film, and the like. A support to be used can be selected appropriately from among them according to the particular intended end use.

Processing steps (image formation steps) according to the present invention are described below.

The color development processing step according to this invention is completed within a short processing time, viz., within 2 minutes and 30 seconds. A preferred processing time is from 1 minute to 2 minutes and 10 seconds. The processing time herein referred to means a time period between the contact with a color developing solution and the contact with a next bath, thus covering the time required for transfer between baths.

The color developing solution which can be used in this invention preferably comprises an alkaline aqueous solution containing an aromatic primary amine color developing agent as a main component. The color developing agent preferably includes p-phenylenediamine compounds, such as 3-methyl-4-amino-N,N-diethylaniline, 3-methyl-4-amino-N-ethyl-N-8-hydroxylethylaniline, 3-methyl-4-amino-N-ethyl-N-8-methanesulfonamidoethylaniline, 3-methyl-4-amino-N-ethyl-N-6-methoxyethylaniline, and a sulfate, a hydrochloride, a phosphate, a p-toluenesulfonate, a tetraphenylborate, or a p-(t-octyl)benzenesulfonate of these p-phenylenediamine compounds.

Aminophenol derivatives which can be used as color developing agents include o- or p-aminophenol, 4-amino-2-methylphenol, 2-amino-3-methylphenol, 2-oxy 3-amino-1,4-dimethylbenzene, etc.

In addition, the compounds disclosed in L.F.A. Mason, *Photographic Processing Chemistry*, pp. 226–229, Focal Press (1966), U.S. Pat. No. 2,193,015 and 2,592,364, and Japanese Patent Application (OPI) No. 64933/73 can also be employed as color developing agents. If desired, these color developing agents may be used in combinations of two or more thereof.

The processing temperature for color development with the color developing solution preferably ranges from 30° to 50° C., and more preferably from 35° to 45° C.

The color developing solution can contain any known development accelerators except that the solution contains substantially no benzyl alcohol. Usable development accelerators include various pyrimidium compounds as described in U.S. Pat. Nos. 2,648,604 and 3,171,247 and Japanese Patent Publication No. 9503/69, other cathionic compounds; cathionic dyes, e.g., phenosafranine; neutral salts, e.g., thallium nitrate or potassium nitrate; polyethylene glycol or its derivatives as described in Japanese Patent Publication No. 9304/69 and U.S. Pat. Nos. 2,533,990, 2,531,832, 2,950,970 and 2,577,127; nonionic compounds, such as polythioethers; thioether compounds as described in U.S. Pat. No. 3,201,242, and the compounds described in Japanese Patent Application (OPI) Nos. 156934/83 and 220344/85.

In rapid development processing as in the present invention, not only development acceleration but also prevention of development fog are important subjects to consider. Fog inhibitors which are preferably used in the present invention include alkali metal halides, e.g., potassium bromide, sodium bromide, potassium iodide, etc., and organic antifoggants Examples of the organic antifoggants are nitrogen-containing heterocyclic compounds, e.g., benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, hydroxyazaindolizine, etc.; mercapto-substituted heterocyclic compounds, e.g., 1-phenyl-5-mercaptotetrazole, 2-mercaptobenzimidazole, 2-mercaptobenzothiazole, etc.; and mercapto-substituted aromatic compounds, e.g., thiosalicyclic acid, etc. Of these antifoggants, halides are particularly preferred. It does not matter if these antifoggants are dissolved out from the light-sensitive materials during processing and accumulated in the color developing solution.

Other additives that may be added to the color developing solution include pH buffers, such as carbonate, borates or phosphates of alkali metals; preservatives, such as hydroxylamine, triethanolamine, the compounds described in West German Patent (OLS) No. 2622950, sulfites, and bisulfites; organic solvents, such as diethylene glycol; dye forming couplers; competing couplers, nucleating agents, such as sodium boron hydride; auxiliary developing agents, such as 1-phenyl-3-pyrazolidone; tacktifiers; and chelating agents, such as aminooolycarboxylic acids, e.g., ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, triethylenetetraminehexaacetic acid, and the compounds described in Japanese Patent Application (OPI) No. 195845/83, etc., 1-hydroxyethylidene-1,1'-diphosphonic acid, the organic phosphonic acids described in RD 18170 (May, 1979), aminophosphonic acids, e.g., aminotris(methylenephosphonic acid), ethylenediamine-N,N,N',N'-tetramethylenephosphonic acid, etc., and phosphonocarboxylic acids as described in Japanese Patent Application (OPI) Nos. 102726/77, 42730/78, 121127/79, 4024/80, 4025/80, 126241/80, 65955/80, and 65956/80, and Research Disclosure, RD 18170 (May, 1979).

If desired, the color development bath may be divided into two or more portions, and a replenisher may be added to the first or last bath to thereby reduce the development time and/or the amount of replenishment.

The silver halide color light-sensitive material after color development is usually subjected to bleach. Bleaching processing may be carried out simultaneously with fixation (bleach-fix), or these two steps may be carried out separately. Bleaching agents to be used include compounds of polyvalent metals, e.g., iron (III), cobalt (III), chromium (VI), copper (II), etc., peracids, quinones, nitroso compounds, and the like. Examples of these bleaching agents are ferricyanides; bichromates; organic complex salts of iron (III) or cobalt (III), e.g., complex salts with aminopolycarboxylic acids, e.g., ethylenediaminetetraacetic acid, diethylenetriaminepentaacetic acid, nitrilotriacetic acid, 1,3-diamino-2-propanoltetraacetic acid, etc., or organic acids, e.g., citric acid, tartaric acid, malic acid, etc.; persulfates; manganates; nitrosophenol; and the like. Among them, potassium ferricyanide, sodium (ethylenediaminetetraacetato)iron (III), ammonium (ethylenediamine tetraacetato)iron (III), ammonium (triethylenetetraminepentaacetato)iron (III), and persulfates are particularly useful. In particular, (ethylenediaminetetraacetato)iron (III) complex salts are useful in both an independent bleaching bath and a combined bleach-fix monobath.

If desired, the bleaching solution or bleach-fix solution can contain various accelerators, such as bromine ions, iodine ions, thiourea compounds as described in U.S. Pat. No. 3,706,561, Japanese Patent Publication No. 8506;70 and 26586/74, and Japanese Patent Application (OPI) Nos. 32735/78, 36233/78, and 37016/78; thiol compounds as described in Japanese Patent Application (OPI) Nos. 124424/78, 95631/78, 57831/78, 32736/78, 65732/78, and 52534/79, and U.S. Pat. No. 3,893,853; heterocyclic compounds as described in Japanese Patent Application (OPI) Nos. 59644/74, 140129/75, 28426/78, 141623/78, 104232/78, and 35727/79; thioether compounds as described in Japanese Patent Application (OPI) Nos. 20832/77, 25064/80, and 26506/80; quaternary amines as described in Japanese Patent Application (OPI) No. 84440/73; thiocarbamoyls as described in Japanese Patent Application (OPI) No. 42349/75; and the like.

Fixing agents to be used include thiosulfates, thiocyanates, thioether compounds, thioureas, and a large quantity of an iodide, with thiosulfates being commonly employed. Preservatives suitable for the bleach-fix or fixing solution include sulfites, bisulfites, and carbonyl-bisulfite addition compounds.

The bleach-fix or fixation is usually followed by washing. Various known compounds can be used in the washing processing for the purpose of prevention of sedimentation and/or saving water. For example, water softeners for prevention of sedimentarion, such as inorganic phosphoric acids, aminopolycarboxylic acids, organic phosphoric acids, etc., sterilizers or fungicides for prevention of growth of various bacteria, algae, and mold, hardening agents, such as magnesium salts and aluminum salts, and surface active agents for reduction of a drying load or prevention of drying unevenness can be added, if desired. The compound described in L.E. West, *Photo. Sci. and Eng.*, Vol. 9, No. 6 (1965) may also be used. Addition of chelating agents or fungicides are particularly beneficial. It is possible to save water by carrying out the washing step in a countercurrent system using multiple stages (e.g., 2 to 5 stages).

The washing step may be followed by or replaced by a multi-stage countercurrent stabilization step as disclosed in Japanese Patent Application (OPI) No. 8543/82. In this case, from 2 to 9 countercurrent baths are required. Various compounds are added to the stabilization baths for the purpose of image stabilization. Such compounds include pH buffers (e.g., borates, metaborates, borax, phosphates, carbonates, potassium hydroxide, sodium hydroxide, aqueous ammonia, monocarboxylic acids, dicarboxylic acids, polycarboxylic acids, etc.) and formalin. If desired, water softeners (e.g., inorganic phosphonic acids, aminopolycarboxylic acids, organic phosphoric acids, aminopolyphosphonic acids, phosphonocarboxylic acids, etc.), stericizers (e.g., proxelisothiazolone, 4-thiazolylbenzimidazole, halogenated phenolbenzotriazoles, etc.), surface active agents, fluorescent brightening agents, hardening agents, etc., may also be added.

The stabilizing baths may further contain as a pH adjustor after the processing, various ammonium salts, e.g., ammonium chloride, ammonium nitrate, ammonium sulfate, ammonium phosphate, ammonium sulfite, ammonium thiosulfate, etc.

This invention will now be illustrated in greater detail with reference to the following examples, but it should be understood that they are not intended to limit the present invention. In these examples, all the percents are by weight unless otherwise indicated.

EXAMPLE 1

A paper support laminates on both sides thereof with polyethylene was coated with first to seventh layers in the order listed below to prepare a multi-layer color paper. The polyethylene layer on the side to be coated contained titanium dioxide as a white pigment and ultramarine as a blue dye.

| | |
|---|---|
| 1st Layer (Blue-Sensitive Layer): | |
| Silver chlorobromide emulsion (silver bromide: 80 mol %) | 0.30 g Ag/m$^2$ |
| Gelatin | 1.86 g/m$^2$ |
| Yellow coupler (a) | 0.82 g/m$^2$ |
| Color image stabilizer (b) | 0.19 g/m$^2$ |
| Solvent (c) | 0.34 ml/m$^2$ |
| 2nd Layer (Color Mixing Preventing Layer): | |
| Gelatin | 0.99 g/m$^2$ |
| Color mixing inhibitor (d) | 0.08 g/m$^2$ |
| 3rd Layer (Green-Sensitive Layer): | |
| Silver chlorobromide emulsion (silver bromide: 75 mol %) | 0.16 g Ag/m$^2$ |
| Gelatin | 1.80 g/m$^2$ |
| Magenta coupler (e) | 0.34 g/m$^2$ |
| Color image stabilizer (f) | 0.20 g/m$^2$ |
| Solvent (g) | 0.68 ml/m$^2$ |
| 4th Layer (Ultraviolet Absorbing Layer): | |
| Gelatin | 1.60 g/m$^2$ |
| Ultraviolet absorbant (h) | 0.62 g/m$^2$ |
| Color mixing inhibitor (i) | 0.05 g/m$^2$ |
| Solvent (j) | 0.26 ml/m$^2$ |
| 5th Layer (Red-Sensitive Layer): | |
| Silver chlorobromide emulsion (silver bromide: 70 mol %) | 0.26 g Ag/m$^2$ |
| Gelatin | 0.98 g/m$^2$ |
| Cyan coupler (k) | 0.38 g/m$^2$ |
| Color image stabilizer (l) | 0.17 g/m$^2$ |
| Solvent (m) | 0.23 ml/m$^2$ |
| 6th Layer (Ultraviolet Absorbing Layer): | |
| Gelatin | 0.54 g/m$^2$ |
| Ultraviolet absorbent (h) | 0.21 g/m$^2$ |
| Solvent (j) | 0.09 ml/m$^2$ |
| 7th Layer (Protective Layer): | |
| Gelatin | 1.33 g/m$^2$ |
| Acryl-modified polyvinyl alcohol (degree of modification: 17%) | 0.17 g/m$^2$ |

The coating solution for the first layer was prepared as follows.

Yellow coupler (a) (19.1 g) and 4.4 g of color image stabilizer (b) were dissolved in 27.2 ml of ethyl acetate and 7.9 ml of solvent (c). The solution was dispersed in 185 ml of a 10% gelatin aqueous solution containing 8 ml of 10% sodium dodecylbenzenesulfonate.

To a silver chlorobromide emulsion (silver bromide: 80 mol %; Ag content: 70 g/Kg) was added a blue sensitizing dye of formula shown below in an amount of $7.0\times10^{-4}$ mol per mol of silver chlorobromide to prepare 90 g of a blue-sensitive emulsion. The emulsion and the above-prepared dispersion were mixed, and the gelatin concentration of the mixture was adjusted so as to have the above-specified composition. Each coating composition for the 2nd to 7th layers was prepared in the same manner as for the 1st layer. In each layer, sodium 1-oxy-3,5-dichloro-s-triazine was used as a gelatin hardening agent.

Spectral sensitizers used in the emulsions are shown below:

Blue-Sensitive Emulsion Layer:

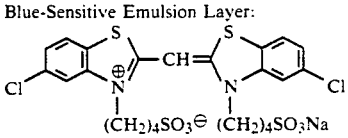

($7.0\times10^{-4}$ mol/mol of silver halide)

Green-Sensitive Emulsion Layer:

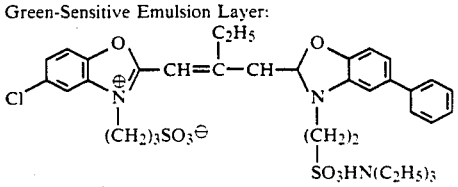

($4.0\times10^{-4}$ mol/mol of silver halide)

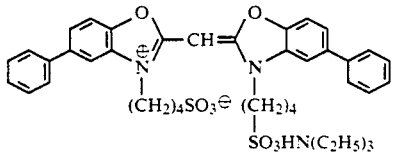

($7.0\times10^{-5}$ mol/mol of silver halide)

Red-Sensitive Emulsion Layer:

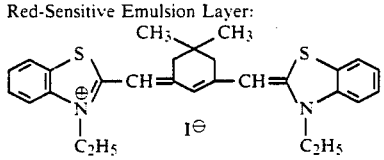

($1.0\times10^{-4}$ mol/mol of silver halide)

Further the following compounds were added in the green-sensitive and red-sensitive emulsions as anti-irradiation dye, respectively.

Green-Sensitive Emulsion Layer:

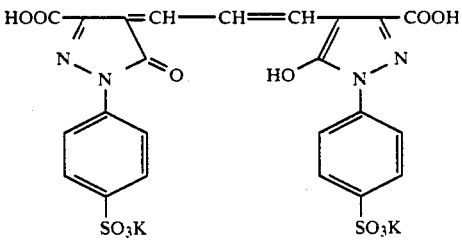

Red-Sensitive Emulsion Layer:

-continued
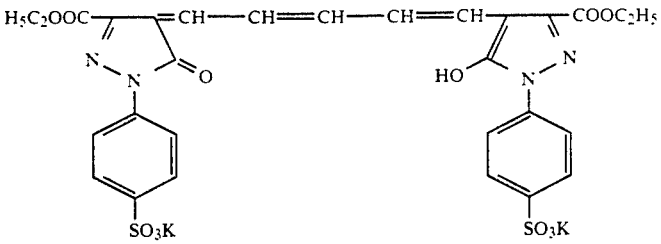
Other compounds used in the preparation of the sample are shown below:
(a) Yellow Coupler:
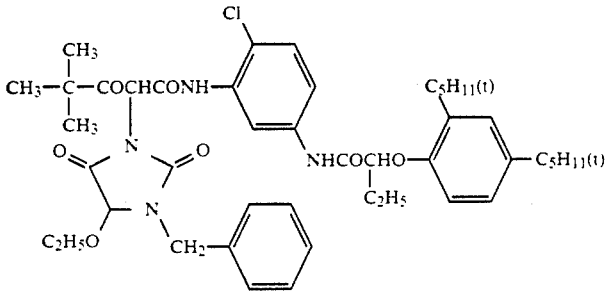
(b) Color Image Stabilizer:
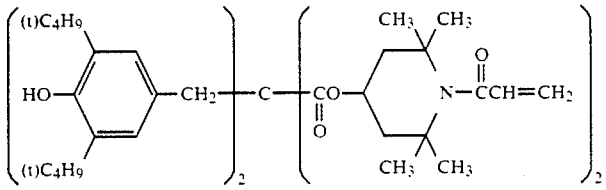
(c) Solvent:
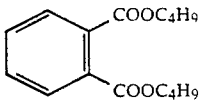
(d) Color Mixing Inhibitor:
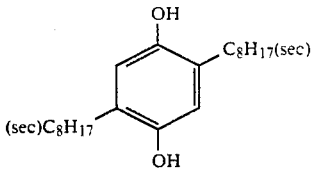
(e) Magenta Coupler:
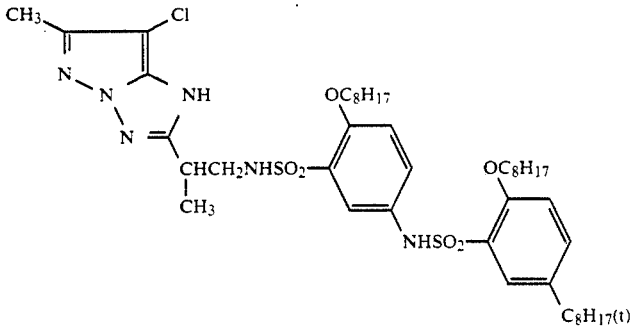
(f) Color Image Stabilizer:

-continued
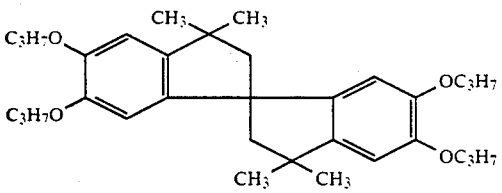
(g) Solvent:
A 2/1 (by weight) mixture of
$(C_8H_{17}O)_3{-}P{=}O$ and
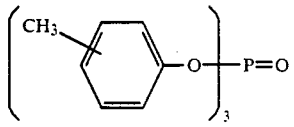
(h) Ultraviolet Absorbent:
A 1/5/53 (by mole) mixture of
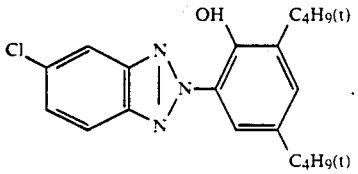
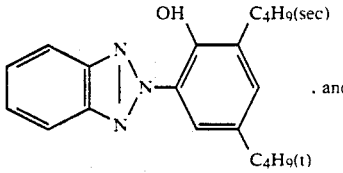
. and
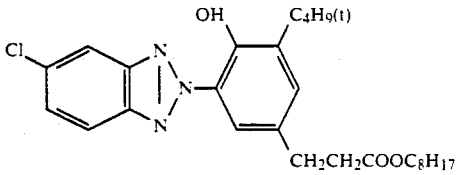
(i) Color Mixing Inhibitor:
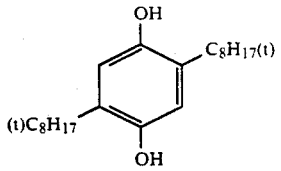
(j) Solvent:
$(iso\text{-}C_9H_{18}O)_3P{=}O$
(k) Cyan Coupler:
A 1/1 (by mole) mixture of
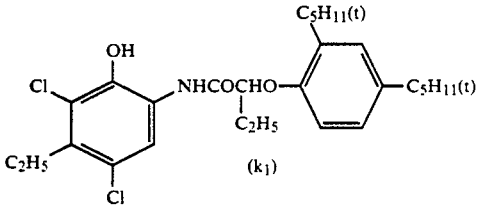
and
$(k_1)$ -continued

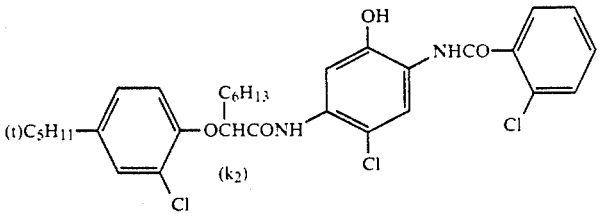

(l) Color Image Stabilizer:
A 1/3/3 (by mole) mixture of

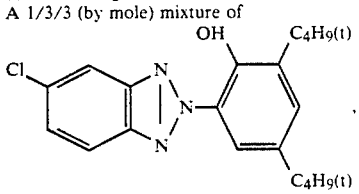

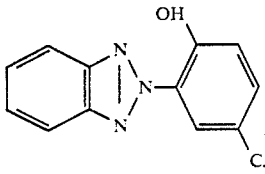

, and

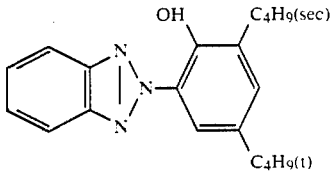

(m) Solvent:

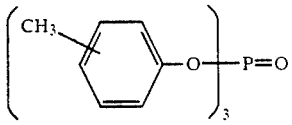

The thus prepared light-sensitive material was designated as Sample 101.

Samples 102 to 108 were prepared in the same manner as for Sample 101 except that the 6th layer further contained 0.3 mmol/m$^2$ of Compound (1), (2), (3), (5), (8), (10), or (24), respectively.

Samples 109 and 110 were prepared in the same manner as for Sample 101 except that each of the 2nd, 4th, and 6th layer further contained 0.1 mmol/m$^2$ of Compound (1) or (2), respectively.

Each of Samples 101 to 110 was sensitometirically exposed to light at an exposure of 250 CMS (candle-meter-second) for 0.5 second through each of blue (B), green (G), and red (R) filters by means of a sensitometer (FWH Model, manufactured by Fuji Photo Film Co., Ltd.: color temperature of light source: 3,200° K.). The exposed sample was subjected to Processing (A) or (B) using Color Developer (A) or (B), respectively, under the following conditions. A difference between Processing (A) and Processing (B) lies only in the formulation of the color developer.

| Processing Step | Temperature | Time |
|---|---|---|
| Color Development | 38° C. | 2.0 min. |
| Bleach-Fix | 38° C. | 1.0 min. |
| Washing | 28-35° C. | 3.0 min. |

-continued

| Color Developer (A) Formulation: | |
|---|---|
| Pentasodium diethylenetriamine-pentaacetate | 2.0 g |
| Benzyl alcohol | 15 ml |
| Diethylene glycol | 10 ml |
| Sodium sulfite | 2.0 g |
| Potassium bromide | 1.0 g |
| Hydroxylamine sulfate | 3.0 g |
| 4-Amino-3-methyl-N-ethyl-N-[β-(methanesulfonamido)ethyl]-p-phenylenediamine sulfate | 5.0 g |
| Sodium carbonate monohydrate | 30.0 g |
| Fluorescent brightening agent (stilbene type) | 1.0 g |
| Water to make | 1000 ml (pH = 10.2) |

| Color Developer (B) Formulation: | |
|---|---|
| Pentasodium diethylenetriamine-pentaacetate | 2.0 g |
| Sodium sulfite | 2.0 g |
| Potassium bromide | 1.0 g |
| Hydroxylamine sulfate | 3.0 g |
| 4-Amino-3-methyl-N-ethyl-N-[β-(methanesulfonamido)ethyl]-p-phenylenediamine sulfate | 5.0 g |
| Sodium carbonate monohydrate | 30.0 g |
| Fluorescent brightening agent (stylbene type) | 1.0 g |
| Water to make | 1000 ml (pH = 10.2) |

-continued

| Bleach-Fix Bath Fomulation: | |
|---|---|
| Ammonium thiosulfate (54 wt %) | 150 ml |
| Sodium sulfite | 15 g |
| Ammonium (ethylenediaminetetra-acetato)iron (III) | 55 g |
| Disodium ethylenediaminetetraacetate | 4 g |
| Water to make | 1000 ml (pH = 6.9) |

Photographic properties of the thus processed samples were evaluated in terms of relative sensitivity and maximum density (Dmax). The relative sensitivity is a reciprocal of an exposure required for providing a density of (minimum density +0.5), and the sensitivity of Sample 101 as obtained in Processing (A) was taken as 100. The results of the evaluations are shown in Table 1 below.

TABLE 1

| Sample No. | Compound (I) No. | Amount of Compound (I) (mmol/m²) 2nd Layer | 4th Layer | 6th Layer | Processing A Relative Sensitivity B | G | R | $D_{max}$ B | G | R | Processing B Relative Sensitivity B | G | R | $D_{max}$ B | G | R | Remark |
|---|---|---|---|---|---|---|---|---|---|---|---|---|---|---|---|---|---|
| 101 | — | — | — | 0.3 | 100 | 100 | 100 | 2.22 | 2.69 | 2.75 | 62 | 75 | 56 | 1.60 | 1.87 | 2.12 | Comparison |
| 102 | (1) | — | — | 0.3 | 112 | 115 | 112 | 2.31 | 2.78 | 2.80 | 105 | 110 | 110 | 2.24 | 2.74 | 2.78 | Invention |
| 103 | (2) | — | — | 0.3 | 112 | 112 | 110 | 2.28 | 2.75 | 2.79 | 100 | 100 | 105 | 2.20 | 2.69 | 2.76 | " |
| 104 | (3) | — | — | 0.3 | 107 | 107 | 107 | 2.24 | 2.72 | 2.76 | 95 | 98 | 95 | 2.16 | 2.68 | 2.73 | " |
| 105 | (5) | — | — | 0.3 | 105 | 107 | 107 | 2.24 | 2.73 | 2.78 | 93 | 90 | 90 | 2.10 | 2.60 | 2.70 | " |
| 106 | (8) | — | — | 0.3 | 105 | 100 | 105 | 2.24 | 2.70 | 2.76 | 90 | 90 | 90 | 2.10 | 2.58 | 2.69 | " |
| 107 | (10) | — | — | 0.3 | 100 | 105 | 105 | 2.21 | 2.71 | 2.77 | 91 | 93 | 93 | 2.13 | 2.61 | 2.72 | " |
| 108 | (24) | — | — | 0.3 | 115 | 112 | 112 | 2.30 | 2.76 | 2.80 | 100 | 110 | 105 | 2.21 | 2.72 | 2.74 | " |
| 109 | (1) | 0.1 | 0.1 | 0.1 | 112 | 115 | 110 | 2.28 | 2.77 | 2.78 | 100 | 110 | 110 | 2.21 | 2.70 | 2.78 | " |
| 110 | (2) | 0.1 | 0.1 | 0.1 | 115 | 112 | 110 | 2.28 | 2.74 | 2.80 | 100 | 95 | 100 | 2.20 | 2.64 | 1.75 | " |

As can be seen from Table 1, when color development step is carried our in a short time, i.e., 2 minutes, Sample 101 (comparison shows greatly deteriorated photographic properties when processed with Developer (B) as compared with Developer (A), indicating that this comparative sample is unsuitable for processing using no benzyl alcohol. On the other hand, the results of Samples 102 to 110 containing the compound of formula (I) according to the present invention are nor so greatly different from those of Sample 101 in the case of Processing (A), but show marked improvements in photographic properties over Sample 101 in the case of Processing (B), exhibiting high performances nearly equal to those attained in the case of Processing (A). It can also be seen that these effects do not change if the compound of the invention is evenly distributed among three layers.

EXAMPLE 2

The Color Developer (B) as used in Example 1 was designated as Developer 201. Developers 202 to 210 were prepared by adding Compound (1), (2), (3), (5), (8), (10) and (24) thereto respectively Sample 101 as prepared in Example 1 was exposed and development processed in the same manner as in Example 1 except for using each of Developers 201 to 210. The resulting processed samples were evaluated in the same manner as in Example 1, and the results obtained are shown in Table 2 below.

TABLE 2

| Developer No. | Compound (I) | Amount of Compound (I) (mmol/liter) | Relative Sensitivity B | G | R | D max B | G | R |
|---|---|---|---|---|---|---|---|---|
| 201 (comparison) | — | — | 62 | 75 | 56 | 1.60 | 1.87 | 2.12 |
| 202 | (1) | 0.5 | 87 | 87 | 87 | 2.08 | 2.56 | 2.70 |
| 203 | (1) | 2.0 | 105 | 110 | 100 | 2.23 | 2.72 | 2.74 |
| 204 | (2) | 2.0 | 100 | 100 | 95 | 2.20 | 2.69 | 2.18 |
| 205 | (3) | 2.0 | 93 | 90 | 90 | 2.11 | 2.62 | 2.72 |
| 206 | (5) | 2.0 | 90 | 90 | 87 | 2.09 | 2.60 | 2.69 |
| 207 | (8) | 2.0 | 90 | 85 | 90 | 2.08 | 2.60 | 2.70 |
| 208 | (10) | 2.0 | 85 | 85 | 85 | 2.05 | 2.56 | 2.66 |
| 209 | (24) | 0.5 | 90 | 85 | 87 | 2.07 | 2.55 | 2.69 |
| 210 | (24) | 2.0 | 100 | 105 | 105 | 2.21 | 2.70 | 2.76 |

It can be seen from Table 2 that the polyamine compounds according to the present invention, when added to a color developing solution free from benzyl alcohol, provide satisfactory photographic properties even in color development processing completing in a short time of 2 minutes without increasing silver coverage.

As described above, elimination of benzyl alcohol from the color development processing system lessens the burden of prevention of environmental pollution, simplifies the preparation of a developing solution, and is also effective to prevent density reduction ascribable to formation of a leuco compound of a cyan dye. Further, the presence of the compound of formula (I) according to the present invention in any layer of silver halide color photographic materials and/or a color developing solution is effective to inhibit changes in photographic performances, such as densities, sensitivity, and gradation, that have conventionally been brought about by eliminating benzyl alcohol from a color developing solution and conducting color development processing in a short time of not more than 2 minutes and 30 seconds.

While the invention has been described in detail and with reference to specific embodiments thereof, it will be apparent to one skilled in the art that various changes and modifications can be made therein without departing from the spirit and scope thereof.

What is claimed is:

1. A method for color image formation comprising imagewise exposing a color photographic light-sensitive material comprising a reflective support having provided thereon at least one light-sensitive layer which contains a mono-dispersed emulsion of silver halide having a ratio of a satistical deviation (s) to a mean grain size ($\bar{d}$) of 0.2/1 or less and which contains a color coupler capable of forming a non-diffusible color image upon coupling with an oxidation product of an aromatic primary amine developing agent and a silver halide emulsion, and processing the exposed light-sensitive material with a color developing solution which does not contain more than 0.5 ml/l of benzyl alcohol within a development time of 2 minutes and 30 seconds, wherein said color development solution contains an aromatic primary amine developing agent selected from the group consisting of 3-methyl-4-amino-N-ethyl-N-β-methanesulfonamidoethylaniline and 3-methyl-4-amino-N-ethyl-N-β-hydroxylethylaniline, and said processing is carried out in the presence of at least one compound represented by formula (I)

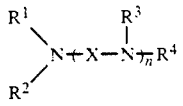

(I)

wherein $R^1$, $R^2$, $R^3$, and $R^4$ each represents a hydrogen atom, an unsubstituted alkyl group, an unsubstituted alkenyl group, an unsubstituted alkynyl group, a substituted alkyl, alkenyl or alkenyl group wherein the substituted alkyl, alkenyl, or alkynyl group wherein the substituent is an alkoxy group, an amino group, or a sulfo group; an acyl group, or a sulfonyl group; or $R^1$ and $R^2$, or $R^3$ and $R^4$ together form a ring; X represents a straight chain unsubstituted alkylene group containing 2 or 3 carbon atoms; and n represents an integer of 2, 3 or 4.

2. A method as in claim 1, wherein said aromatic primary amine developing agent is 3-methyl-4-amino-N-ethyl -N-β-methanesulfonamidoethylaniline.

3. A method as in claim 2, wherein $R^1$, $R^2$, $R^3$, and $R^4$ each represents a hydrogen atom, a methyl group, or an ethyl group.

4. A method as in claim 3, wherein $R^1$, $R^2$, $R^3$, and $R^4$ each represents a hydrogen atom.

5. A method as in claim 1, wherein n is 2.

6. A method as in claim 1, wherein said compound is present in at least one of a layer of the light-sensitive material and a color developing solution.

7. A method as in claim 6, wherein said compound is present in a color developing solution in an amount of from $1\times10^{-5}$ to $5\times10^{-2}$ mol per liter.

8. A method as in claim 7, wherein said compound is present in a color developing solution in an amount of from $1\times10^{-4}$ to $1\times10^{-2}$ mol per liter.

9. A method as in claim 1, wherein said alkyl group as represented by $R^1$, $R^2$, $R^3$, or $R^4$ has 1 to 6 carbon atoms.

10. A method as in claim 1, wherein said alkenyl group as represented by $R^1$, $R^2$, $R^3$, or $R^4$ has 2 to 6 carbon atoms.

11. A method as in claim 1, wherein said alkynyl group as represented by $R^1$, $R^2$, $R^3$, or $R^4$ has 2 to 6 carbon atoms.

12. A method as in claim 1, wherein said acyl group as represented by $R^1$, $R^2$, $R^3$, or $R^4$ has 1 to 10 carbon atoms.

13. A method as in claim 1, wherein said ring formed by $R^1$ and $R^2$, or $R^3$ and $R^4$ is a saturated 5- or 6-membered ring.

14. A method as in claim 13 wherein said saturated 5- or 6-membered ring is selected from the group consisting of a pyrrolidine ring, a perhydropyridine ring and a morpholine ring.

15. A method as in claim 1, wherein said color developing solution contains no benzyl alcohol.

16. A method as in claim 1, wherein said ratio $s/\bar{d}$ is 0.15/1 or less.

17. A method as in claim 1, wherein said light-sensitive layer contains an emulsion of silver chlorobromide containing from 20 to 98 mol % of silver bromide.

18. A method as in claim 1, wherein said light-sensitive layer contains an emulsion of silver halide having a cubic or tetradecahedral crystal form.

19. A method as in claim 1, wherein said light-sensitive layer contains an emulsion of silver halide capable of predominantly forming a latent image on the surface thereof upon exposure to light.

20. A method as in claim 1, wherein said development time is within the range of from 1 minute to 2 minutes and 10 seconds.

* * * * *